US005579688A

United States Patent [19]

Byrne et al.

[11] Patent Number: 5,579,688

[45] Date of Patent: Dec. 3, 1996

[54] WASTE COMPACTOR FOR COMPACTING WASTE IN OPEN CONTAINERS

[75] Inventors: Gerard J. Byrne, Enniskerry; Rory Kenealy; Robin G. Rees, both of Dublin, all of Ireland

[73] Assignee: Kenbay Limited An Irish Company, Dublin, Ireland

[21] Appl. No.: 241,230

[22] PCT Filed: Nov. 23, 1992

[86] PCT No.: PCT/IE92/00024

§ 371 Date: Jul. 21, 1994

§ 102(e) Date: Jul. 21, 1994

[87] PCT Pub. No.: WO93/09938

PCT Pub. Date: May 27, 1993

[30] Foreign Application Priority Data

Nov. 21, 1991 [IE] Ireland ..... 4047/91

[51] Int. Cl.[6] ..... B30B 9/30

[52] U.S. Cl. ..... 100/210; 100/68

[58] Field of Search ..... 100/65–68, 210

[56] References Cited

U.S. PATENT DOCUMENTS

| | | | |
|---|---|---|---|
| 641,084 | 1/1900 | Cross | 100/210 |
| 1,109,443 | 9/1914 | McLaughlin | 100/68 |
| 1,217,957 | 3/1917 | Keys | 100/67 |
| 3,720,052 | 3/1973 | Anderson et al. | 100/210 |
| 3,881,409 | 5/1975 | Frigieri | 100/68 |
| 4,426,925 | 1/1984 | Bergmann | 100/210 |
| 4,524,685 | 6/1985 | Bergmann | 100/210 |

FOREIGN PATENT DOCUMENTS

| | | |
|---|---|---|
| 0042580 | 12/1981 | European Pat. Off. . |
| 0106268 | 4/1984 | European Pat. Off. . |
| 2655314 | 6/1978 | Germany . |
| 3132202 | 3/1983 | Germany . |
| 3607352 | 9/1987 | Germany . |
| 3718359 | 12/1988 | Germany . |
| 3903642 | 8/1990 | Germany . |
| 88/09757 | 12/1988 | WIPO . |

*Primary Examiner*—Stephen F. Gerrity
*Attorney, Agent, or Firm*—Sughrue, Mion, Zinn, Macpeak & Seas

[57] ABSTRACT

A waste compactor including an upwardly open waste container, and a roller mounted on a support for movement within the container to travel over waste in the container for compacting waste. The roller is movable up and down in the container as waste builds up in the container. The support includes a support arm slidably mounted on a support frame, the arm being inclined downwardly from the support frame towards the roller. For waste compaction a ram is operable to slide the arm on the support frame to urge the roller against the waste.

17 Claims, 12 Drawing Sheets

WASTE COMPACTOR FOR COMPACTING WASTE IN OPEN CONTAINERS

BACKGROUND OF THE INVENTION

1. Field of the Invention

The invention relates to a waste compactor, in particular for compaction of bulk waste and garbage material such as plastics, paper, cardboard, wood and other compressible articles generally in a container such as a bag, box or a bin, for example, for disposal or recycling purposes.

The invention relates to a waste compactor of the type comprising an upwardly open waste container, a roller mounted on a support for movement within the container to travel over waste in the container for waste compaction, the roller being movable up and down in the container as waste builds up in the container. Waste compactors of this type are particularly suitable for compaction of waste on site as it is generated. They are generally convenient for loading and the compacted wasted can usually safely and easily be removed without any significant "spring-back" or movement of the waste as is sometimes the case with press type compactors.

2. Description of the Related Art

One such device is described in German Patent Specification No. DE 2,655,314 having a roller mounted on an arm within a container at a lower end of a screw which feeds waste to the roller for compaction. For pressing the roller against the garbage either the container may be fixed and the roller moved down onto the waste or the container may be raised up against the roller, the movement being affected by means of a piston or spring. The device is, however, somewhat complex and is unsuitable for relatively bulky waste materials which need to be broken up prior to feeding them into the compactor.

Another device of this type is described in patent specification No. EP 0,106,268. In this case, the roller is mounted on a vertical support arm which is supported co-axially within the container, the roller and support arm being freely movable axially within the container. The pressing of the roller against the waste is effected by only the weight of the roller acting on the surface of the waste within the container.

Similar pressing arrangements have been used in silage presses for a long time. Such an arrangement works reasonably effectively for a generally uniform material to which the construction of the roller can be matched. However, with a wide range of garbage or other waste materials as is often the case the operation may be somewhat unsatisfactory. With easily compressed materials the roller weight may be excessive causing the roller to dig into the garbage. With more robust waste materials, the weight of the roller may not be adequate to initially crush and then compact the garbage materials. Further, the central roller support arm may obstruct the feeding of waste materials to the roller. Also with this type of device, during start-up it is necessary to at least partially fill the container with waste as the roller needs to engage waste in order to circle around the vertical shaft and roll over the waste. If the roller is inserted first and then the waste goes in, the waste can gather on either side of the roller which remains stationary.

A further waste compactor of this type is shown in patent specification No. EP 0,315,674 in which the roller is mounted on an eccentric support arm which extends closely down along a sidewall of the container, a horizontal boom at a lower end of the arm carrying the roller at an inner end adjacent the container axis. While this construction provides less obstruction to the in-feed of garbage to the roller it is not entirely satisfactory as material can trap between the roller and the boom as the roller passes under the boom leading to increased stress and possibly jamming of the roller. Further, garbage can lodge on the horizontal boom or rest between the boom and a side of the container.

The use of cylindrical or substantially cylindrical rollers may in some cases cause problems due to slippage of an inner end of the roller on garbage at the centre of the container because of the differences in the relative speed of travel of inner and outer ends of the roller.

Also the relatively steep approach angle of a cylindrical roller to incoming garbage can cause problems with feeding the garbage between the roller and the compacted garbage to compress it, particularly with relatively bulky waste. Conventional rollers tend to push the garbage ahead of them rather than pulling it in under the roller.

Further, a cylindrical roller must be of a large diameter relative to the size of the un-compacted waste pieces (such as empty cardboard boxes for example), otherwise it may be unable to move over them and may instead become buried beneath them. Since the diameter of the roller must be relatively large (typically one half of the diameter of the compacting container), the roller is unable to travel close to the container walls without scraping off them at its mid-height. The apparatus is therefore obliged to leave a rim of relatively uncompacted material around a periphery of the waste container.

A problem can arise with the use of cylindrical garbage containers in that garbage items can be pushed around the sidewall of the container ahead of the roller.

The present invention is directed towards providing a garbage compactor which will overcome at least some of these problems.

SUMMARY OF THE INVENTION

The invention in one aspect is characterised in that the support comprises a support frame and a support arm which is inclined downwardly from the support frame towards the roller. Thus, advantageously, there is less obstruction to the in-feed of garbage. Further, the arm guides the garbage downwardly into the roller path. Furthermore, there is good clearance between the roller and the arm even when the roller passes directly beneath the arm. Due to the inclination of the arm even if something is caught between the arm and roller, it will tend to be squeezed outwardly towards the container sidewall and into the roller path. Further a waste compacting force can be better applied to the waste through an inclined arm which gives improved force distribution and application. A more positive downward force can be applied to the waste for compaction. Preferably, the arm is inclined at an angle of between 30° and 60° to the central axis of the container, and most preferably at an angle of 45° to the container axis.

In a preferred embodiment of the invention, a ram is provided for movement of the roller through the container, the ram being operable to move the roller and to apply a bias to the roller to control the compaction pressure applied to the waste by the roller. Advantageously, improved compaction control can be achieved by use of the ram.

Preferably, the roller is movable outwardly against a preset ram bias to maintain a substantially constant preset desirable roller compaction pressure on the waste during operation. Thus conveniently, the ram maintains a substantially constant compaction pressure on the garbage for even compaction throughout filling of the container. Ideally, the ram applies a force which is adjustable so that a desirable compaction pressure matching the particular waste being compacted can be selected for optimum compaction.

Conveniently, the support arm is slidably mounted on the support frame and the ram means is mounted between the support arm and the support frame for sliding the arm on the support frame.

Preferably, a shock absorber is provided between the ram and the roller to absorb shock loading on the roller. This advantageously absorbs any initial shock loading should the roller meet a particularly solid piece of waste preventing damage to the compactor. Preferably the shock absorber is of resilient material, especially a shock absorbing spring. Preferably the shock absorber being provided between the ram and the support arm to absorb shock loading on the roller in use. It will be appreciated that the shock absorbing means may be adjustable and further that various different types of shock absorber could be used.

In an a particulary preferred embodiment, the roller is mounted by a carrier arm on the support arm, the carrier arm being rotatable about a central axis of the container. Thus, the carrier arm and roller can be swept around the central axis of the container to roll the roller over the waste. Ideally, carrier arm drive means is provided for rotation of the carrier arm about the central axis of the container. This advantageously ensures that the roller is swept around the container even if there is no garbage in the container such as when starting to fill the container. Thus advantageously, no particular procedure is required when filling the container, the waste can just be thrown in and the roller, as it sweeps around the container, will meet and seize the waste pulling it underneath the roller for compaction.

In another embodiment, roller drive means is provided for rotation of the roller. This assists in rolling the roller over waste in the container and in seizing and pulling waste under the roller for compaction.

In another embodiment, the or each drive means is reversible. The or each drive means may be reversible in response to an associated timer operable to reverse the drive means at preset time intervals.

In a preferred embodiment, the or each drive means is reversible in response to the force exerted on the roller by waste within the container resisting roller movement. Thus advantageously, should a particularly solid piece of waste be thrown into the container and the roller is unable to immediately seize and pull the waste beneath it, the roller reverses and attacks the waste from the opposite side swinging back and forth around the central axis of the container until the waste is gradually disintegrated and compacted.

In another embodiment the roller drive means comprises an hydraulic roller motor mounted on the carrier arm, a rotary hydraulic distributor being mounted between the carrier arm and the support arm for oil passage between an hydraulic power supply and the roller motor to drive the motor.

Preferably, the distributor comprises a cylindrical body having a bore, a shaft rotatably mounted within the bore, a free end of the shaft projecting outwardly of the bore, the carrier arm being mounted at the free end, an oil supply port and an oil return port in an sidewall of the body, each port communicating with an associated annular oil channel extending around the bore, an oil passage extending through the shaft between each channel and free outer end of the shaft for oil delivery to and from the motor.

In another embodiment the carrier arm drive means is an hydraulic carrier arm motor connected to an hydraulic power supply.

Ideally, the carrier arm motor is mounted on the distributor body drivably engaging the shaft.

In another embodiment, the roller is rotatably mounted on the carrier arm.

In another embodiment, the roller is a generally conical roller. Preferably, the roller has a cone angle of between 70° and 120°. Conveniently, the cone angle may be approximately 97°. With a conical roller advantageously the slippage present in cylindrical rollers at the centre of the container when circling the roller is overcome. Further the side of the roller which engages the garbage is more gently sloping than in a similar sized cylindrical roller thus, advantageously giving improved feeding of garbage under the roller. The roller is thus better able to seize the garbage and direct it underneath the roller.

In a particularly preferred embodiment, an apex of the roller lies substantially on the central axis of the container and the roller axis extends radially with respect to the central axis, the roller axis being inclined at an angle of approximately half the cone angle to a plane substantially parallel to a base of the container. Thus advantageously, the roller is supported such that a lowermost edge of the roller travels along a plane substantially parallel to a base of the container for substantially level filling of the container.

It will be noted that the term conical roller as used in this specification is taken to include frusto-conical rollers. In this case, the term apex is taken to mean a narrow inner end of the roller. Preferably, the roller is supported within the container such that a lower most part of the inner end is substantially coincident with the central axis of the container.

In a further embodiment, an outermost edge of the roller and an inner sidewall of the container are so shaped that upon revolution of the roller about the central axis of the container, the outermost edge of the roller rolls around the sidewall closely following the contour of the sidewall. This advantageously ensures that an even compaction of the waste is achieved right across the container including waste adjacent the inner sidewall. The outermost edge of the roller may be circular and the container sidewall of generally circular section. Alternatively, the container sidewall is of generally polygonal section having a number of spaced-apart corners, the outer most edge of the roller having at least one, and preferably, a number of complementary spaced-apart projections such that upon revolution of the roller about the central axis of the container successive projections extend into a mesh with each corner in turn. Ideally, the inner sidewall is of generally rectangular section, preferably square section and the roller has three equi-spaced triangular projections on its outermost edge. Thus advantageously, a square section compacted bale of waste can be produced, these being more economically stored and transported than round bales.

In a further embodiment, the roller is mounted by a carrier arm on the support arm, the carrier arm being rotatable about a central axis of the container. Ideally, the carrier arm is inclined downwardly from the support arm which advantageously tends to direct waste downwardly into the roller path. Where a conical roller is used the carrier arm is preferably inclined downwardly substantially perpendicularly to the roller axis.

In A further embodiment geared drive means are provided between the carrier arm and the roller.

In another embodiment, the container has a waste outlet, sidewalls of the container converging away from the outlet. Thus advantageously, a compacted bale is easily removed from the container. Preferably, the outlet comprises an opening in the sidewall of the container closed by a door or doors, said door or doors operatively connected to an interlock which only allows operation of the roller when the doors are closed. This is an advantageous safety feature preventing operation of the roller when the doors are open which might cause injury to a person operating the waste compactor.

In a particularly preferred embodiment of the invention, a container is of polygonal cross-section having a plurality of internal corners to trap waste for compaction by the roller. The corners may be rounded. Advantageously, a polygonal container has a larger capacity than a cylindrical container of the same width. Ideally, the container is generally rectangular in section, and most preferably the container is of generally square cross-section. Advantageously, rectangular bales of compacted garbage can be more economically stored and transported than round bales.

In a further embodiment, a number of outwardly extending spaced-apart paddles are provided arranged around an outer waste contacting surface of the roller to engage the waste and pull the waste under the roller for shredding and compaction. Preferably, a plurality of waste shredding teeth are provided on the waste contacting surface of the roller.

In another embodiment, means is provided for mounting a removable waste receptacle within the container to receive waste. This may conveniently be for example a plastics bag which is held open beneath the roller for compaction of waste within the bag which can then be removed and replaced.

In a preferred embodiment, a protective collar is mounted in the arm surrounding the roller for insertion with the roller into the container to protect the container or waste receptacle during filling.

In another aspect, the invention provides a waste compactor of the type comprising an upwardly open waste container, a roller mounted on a support for movement within the container to travel over waste in the container for waste compaction, the roller being movable up and down in the container as waste builds up in the container, characterised in that ram means is provided for movement of the roller through the container, the ram means being operable to move the roller and to apply a bias to the roller to control the compaction pressure applied to the waste by the roller.

In a still further aspect, the invention provides a waste compactor of the type comprising an upwardly open waste container, a roller mounted on a support for movement within the container to travel over waste in the container for waste compaction, the roller being movable up and down in the container as waste builds up in the container, characterised in that the roller is a generally conical roller having a cone angle of between 70° and 120°.

BRIEF DESCRIPTION OF THE DRAWINGS

The invention will be more clearly understood by the following description of some embodiments thereof, given by way of example only with reference to the accompanying drawings, which.

DETAILED DESCRIPTION OF PREFERRED EMBODIMENTS

Figure 1:
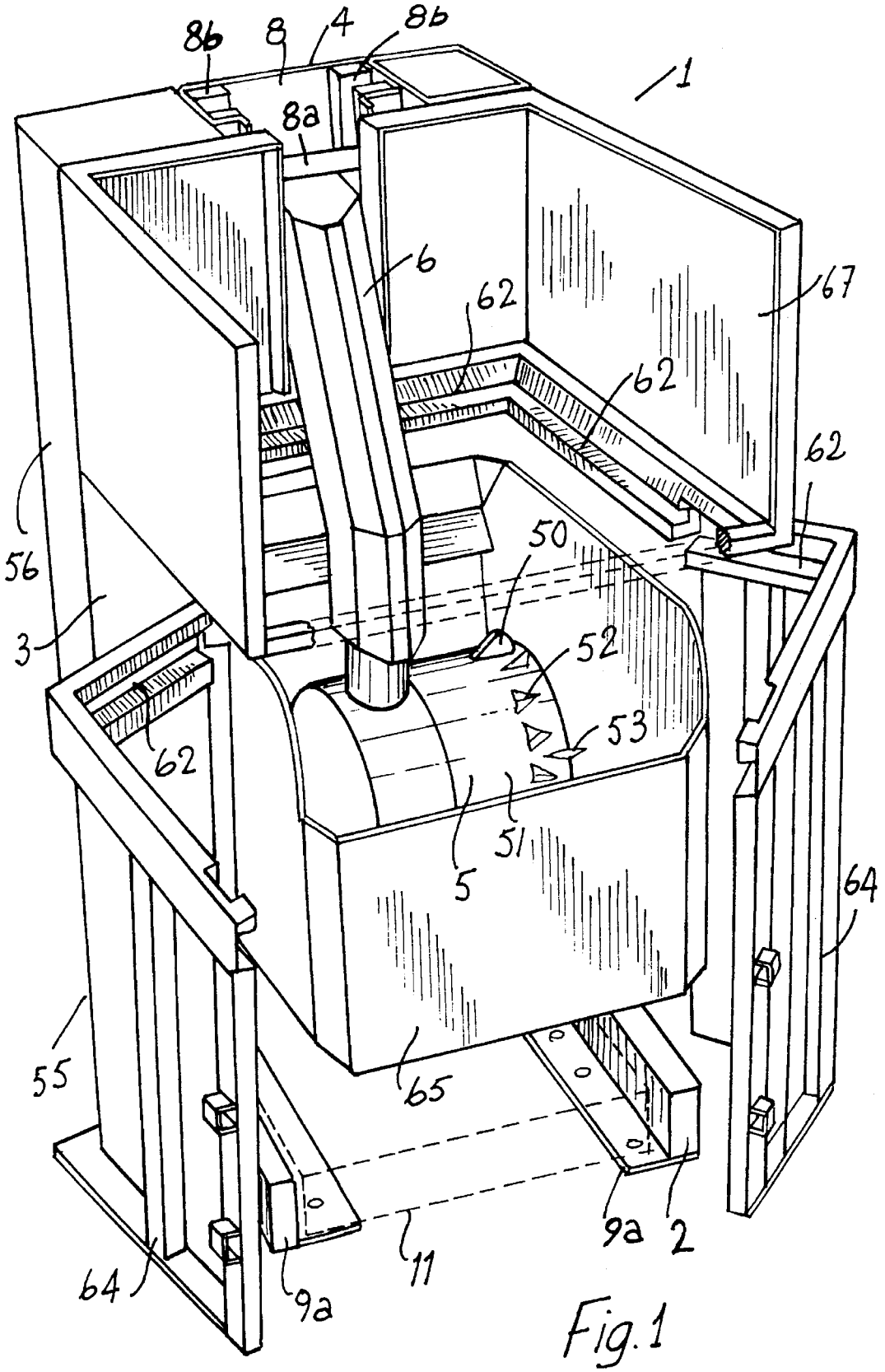
FIG. 1 is a front perspective view of a waste compactor according to the invention.
Figure 2:
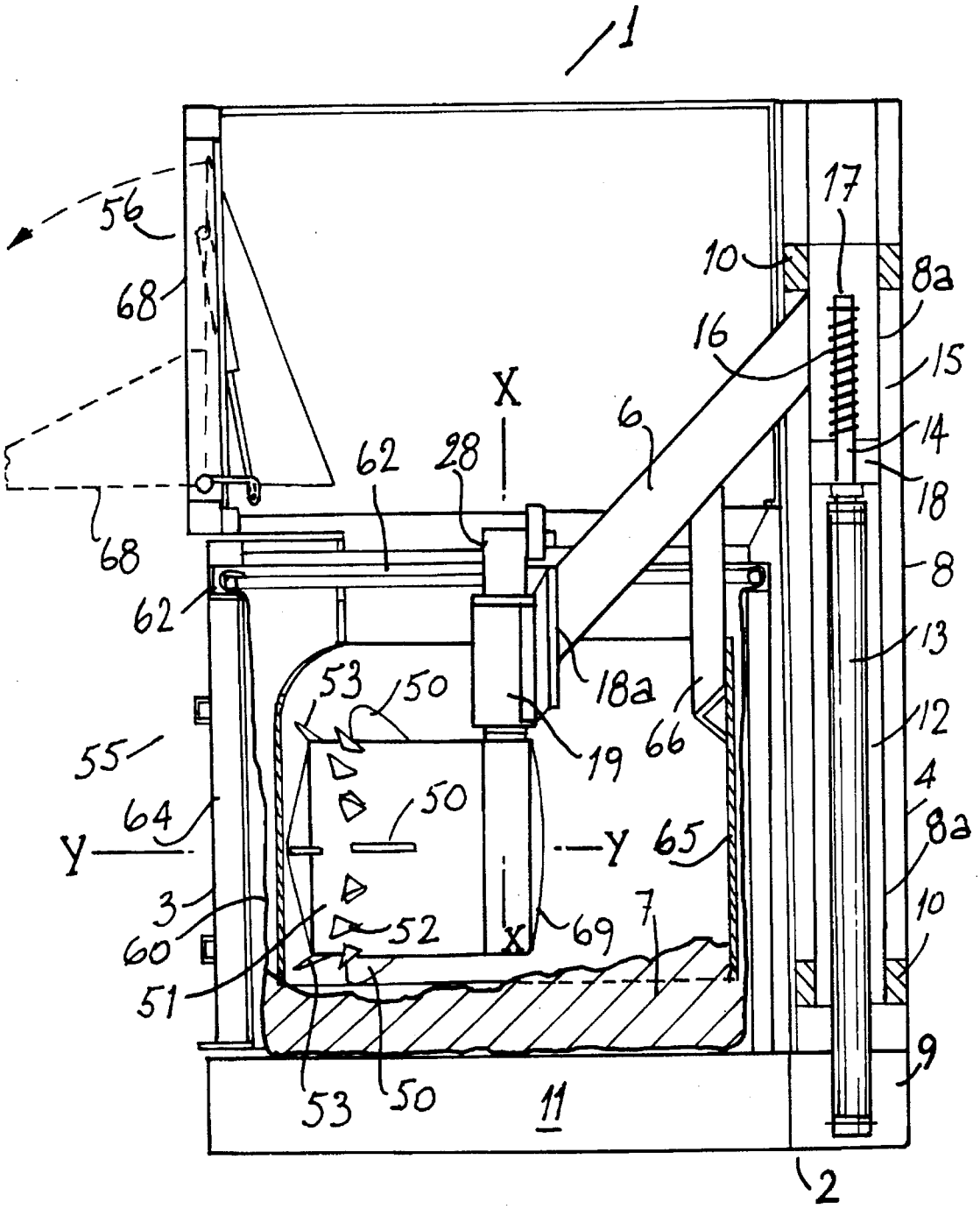
FIG. 2 is a side sectional elevational view of the waste compactor.

Referring to the drawings, and initially to FIGS. 1 to 9 thereof, there is shown a waste compactor according to the invention indicated generally by the reference numeral 1. The waste compactor 1 comprises a waste container 3 with a cylindrical waste compacting roller 5 mounted on a support for movement within the container 3 to travel circularly over waste 7 in the container 3 and movable up and down in the container 3 as waste 7 builds up in the container 3. The support comprises a support arm 6 slidably mounted on a support frame 4, the arm being inclined downwardly at an angle of 45° from the support frame 4 towards the roller 5 to guide waste 7 fed into the container 3 into the path of the roller 5. For waste compaction a ram 12 is operable to slide the arm 6 vertically on the support frame 4 to urge the roller 5 against the waste 7, the ram pressure being adjustable to suit different types of waste 7.

The support frame 4 has a U-shaped ground engaging base 2 having a rear member 9 with a pair of spaced-apart forwardly extending feet 9*a* for reception of a pallet 11 therebetween under an open bottom of the waste container 3 to bale waste 7 on the pallet 11. An upstanding channel-section support post 8 is mounted centrally on the rear member 9 and slidably carries a carriage 8*a* in channel-section guides 8*b* on each side of the support post 8. The carriage 8*a* is formed by a pair of spaced-apart tubular, rectangular section posts interconnected by cross-members, each post sliding in one of the guides 8*b* with spaced-apart wear pads 10 extending therebetween. The wear pads 10 are mounted at a lower end of the carriage 8*a* and at an upper end of the support post 8 within the guides 8*b*.

A hydraulic ram 12 is mounted between the carriage 8*a* and the rear member 9 of the base 2. The ram 12 comprises a cylinder 13 fixed on the rear member 9 and an associated piston 14 engageable with an upper end 15 of the carriage 8*a*. A shock absorbing spring 16 is mounted between a free end 17 of the piston 14 and a bracket 18 on the carriage 8*a*.

The roller support arm 6 extends outwardly from the carriage 8*a* and inclines downwardly towards the roller 5. Mounted at a lower end 18*a* of the support arm 6 is a rotary hydraulic distributor 19 on the lower end of which is mounted the roller 5. The hydraulic distributor 19 is shown in more detail in FIGS. 6 and 7 and has a cylindrical body 20 with a central bore 21 within which is rotatably mounted a shaft 22. Thrust bearings 23 support each end of the shaft 22 in the bore 21. A roller carrier arm 24 is mounted at a lower end of the shaft 22 which projects outwardly of the bore 21. The carrier arm 24 is formed by a mounting plate 24*a* carrying a roller drive motor 25 (see FIG. 5) which drives directly, or through a gear box 25*a*, an internal flange 25*b* on the roller 5 for rotation of the roller 5. An end cover 69 mounted on the lower end of the shaft 22 encloses the motor 25. Oil inlet and outlet transfer ports 26 pass through a sidewall of the body 20 to annular oil channels 26*a* within the bore 21. Associated oil passages 27 communicating with each channel 26*a* pass through the shaft 22 for oil passage through the shaft 22 for delivery to the roller drive motor 25 through hydraulic pipes (not shown). Seals are provided to isolate and prevent oil leakage from each channel 26*a*.

At an upper end of the body 20 an auxiliary hydraulic sweep motor 28 forming a carrier arm drive motor is provided connecting through a splined drive shaft 29 with an upper end of the shaft 22 for rotation of the shaft 22 within the body 20. The hydraulic sweep motor 28 is operable to rotate the carrier arm 24 and hence the roller 5 about the central axis X (FIG. 2) of the container 3. The hydraulic drive motor 25 is operable for rotation of the roller 5 about axis Y (FIG. 2) perpendicular to the central axis X. Hydraulic fluid pipes (not shown) connecting the motors (25, 28) to a hydraulic fluid supply (see FIG. 8) pass through the arm 6.

Figure 8:
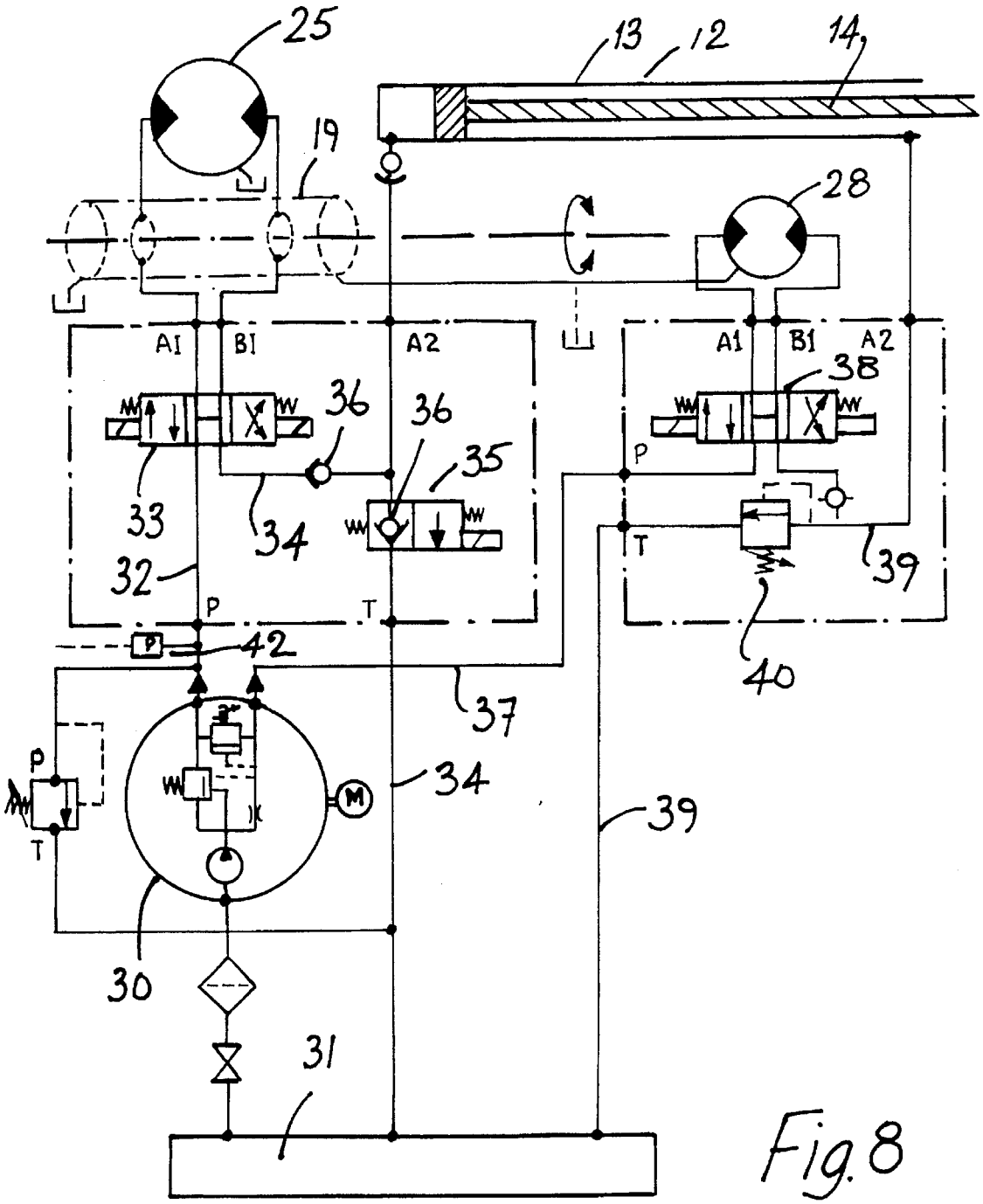
FIG. 8 is a schematic diagram of an hydraulic circuit used in the waste compactor.

Referring now in particular to FIG. 8, a schematic illustration of the hydraulic system for the waste compactor 1 is shown. An hydraulic pump 30 circulates hydraulic oil from a reservoir 31 to the motors 25, 28 to drive the motors 25, 28, oil being returned from the motors 25, 28 to the reservoir 31. A first oil feed line 32 from an outlet of the pump 30 supplies oil through a solenoid operated flow direction control valve 33 controlling the flow of oil through the motor 25 and hence controlling the direction of rotation of the motor 25. Operation of the valve 33 is controlled by a timer to reverse rotation of the motor 25 and hence the roller 5 at a preset time, typically every 10–45 seconds. A solenoid operated valve 35 in an oil return line 34 when energised allows free return of oil to the reservoir 31. When de-energised the valve 35 blocks return of oil to the reservoir 31, the oil being directed instead to a lower end of the ram 12 for lifting the arm 6 and hence the roller 5 within the container 3. Non-return valves 36 prevent lowering of the ram 12 until the valve 35 is again energized.

Oil from the pump 30 is led via a supply line 37 through a solenoid operated flow directional control valve 38 controlling the flow of oil through the sweep motor 28 and hence the direction of rotation of the sweep motor 28. It will be noted that the valves 33, 38 are electrically linked for synchronous operation of the motors 25, 28. A return line 39 returns oil from the motor 28 to the reservoir 31. A pressure relief valve 40 is mounted in the return line 39. Upstream of the relief valve 40 the return line 39 connects to an upper end of the ram 12 for pressing the arm 6 and hence the roller 5 downwardly against waste 7 in the container 3. The lift pressure setting of the relief valve 40 can be adjusted to select the optimum compaction pressure applied to the roller 5 for the particular waste being compacted. A pressure switch 42 in the oil supply line 31 is operable at a preset pressure, in this case 140 bar, to actuate the valves 33, 38 for reversal of the motors 25, 28.

For optimum operation of the waste compactor 1 it is necessary to carefully select and match the speeds of the roller drive motor 25 and the sweep motor 28. If the speeds are too quick the machinery will be over-stressed when the motors 25, 28 reverse. If the speeds are slow then waste compaction is not carried out quickly enough. With this embodiment for a roller diameter of about 460 mm a speed of 10.7 RPM for the sweep motor 28 and a speed of 13.8 RPM for the roller drive motor 25 is advantageous.

A number of spaced-apart radial paddles 50 extend outwardly of an outer waste contacting surface 51 of the roller 5. A number of spaced-apart waste shredding teeth 52 also project outwardly of the waste contacting surface 51 of the roller 5. At an outer free end of the roller 5 ripper teeth 53 project outwardly to prevent material lodging between the free end of the roller 5 and a collar 65 surrounding the roller 5.

In this case, the container 3 is of generally square section and has a lower portion 55 and an upper portion 56. Means is provided for supporting a waste bag 60 within the lower portion 55 of the container 3. The waste bag 60 is supported on a rectangular ring 61 (see FIG. 9) which is slidably engageable within a support channel 62 at an upper end of a lower portion 55 of the container 3. Outwardly opening doors 64 at a front of the lower portion 55 of the container 3 facilitate mounting and removal of the bag 60. An interlock (not shown) is provided associated with the doors 64 such that the motors 25, 28 can only operate when the doors 64 are closed. To protect the bag 60 during use, a protective collar 65 is suspended from the arm 6 by a bracket 66, the collar 65 surrounding the roller 5.

At the upper portion 56 of the container 3, a waste material inlet opening 67 is provided in a sidewall of the container 3, closed by a drop-down door 68 which facilitates feeding of waste into the water compactor 1.

For outdoor use a cover may be mounted on top of the upper portion 56 of the container 3.

Figure 3:
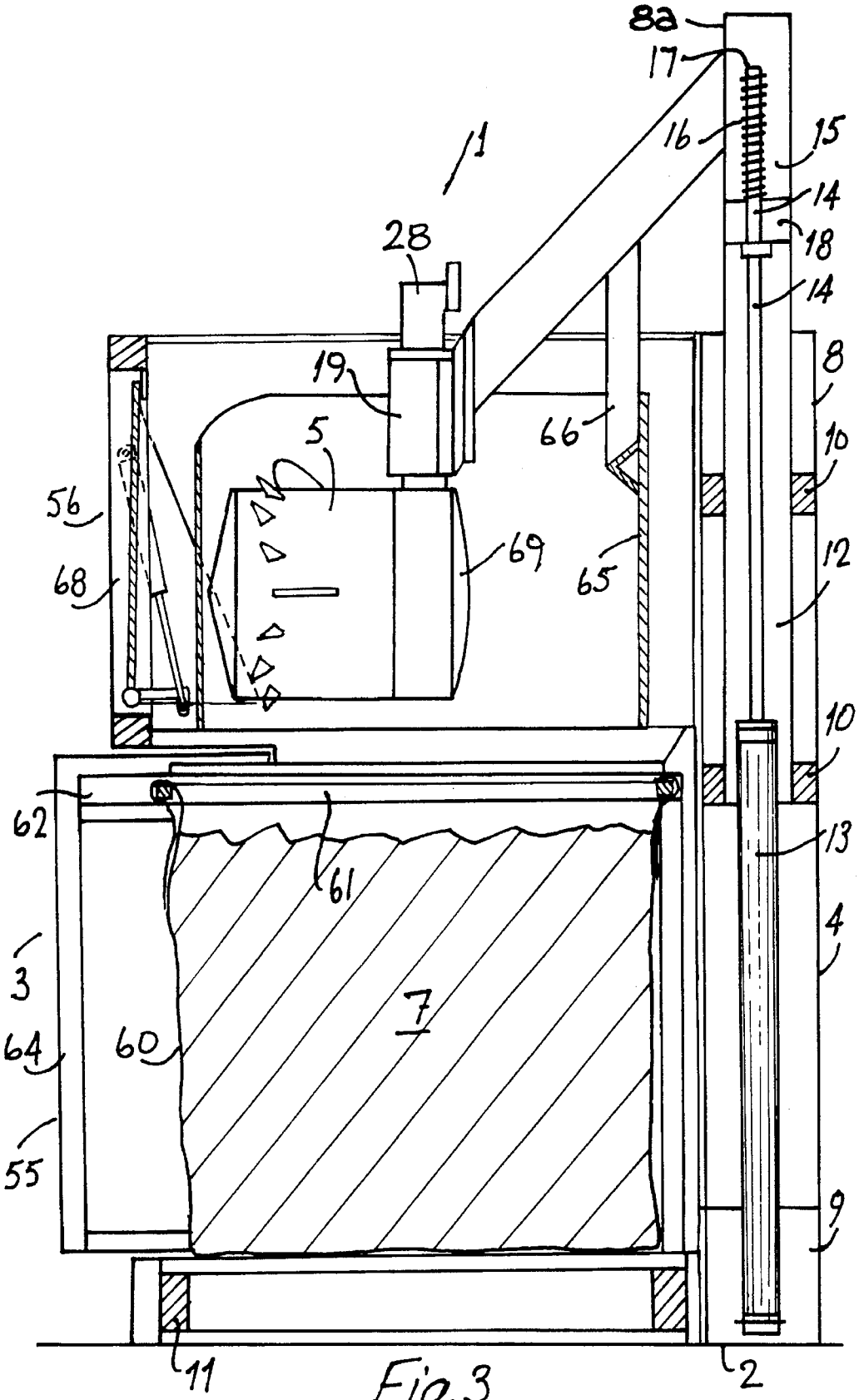
FIG. 3 is a view similar to FIG. 2 showing a compacting roller of the device in a raised inoperative position.
Figure 4:
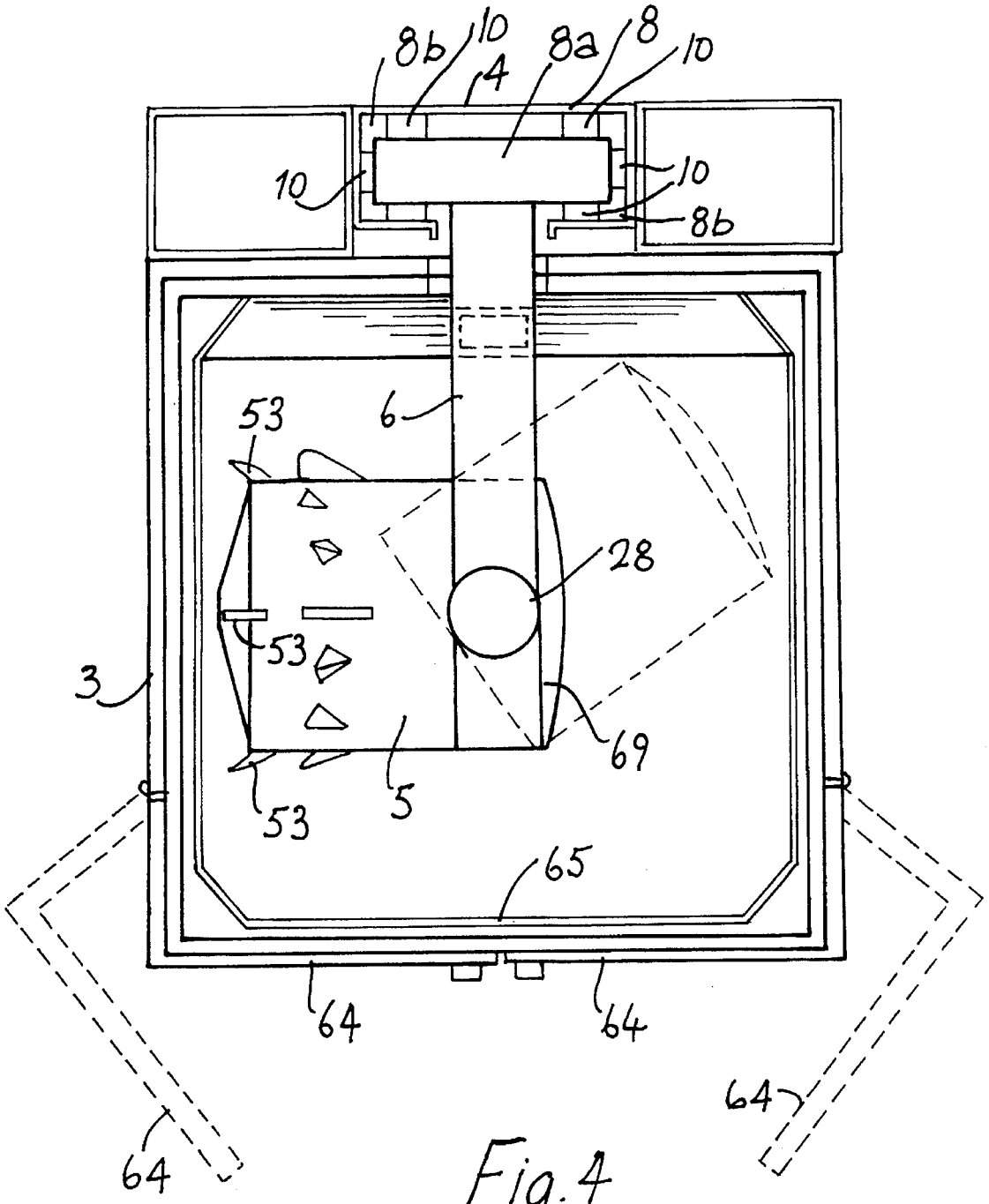
FIG. 4 is a plan view of the waste compactor.
Figure 5:
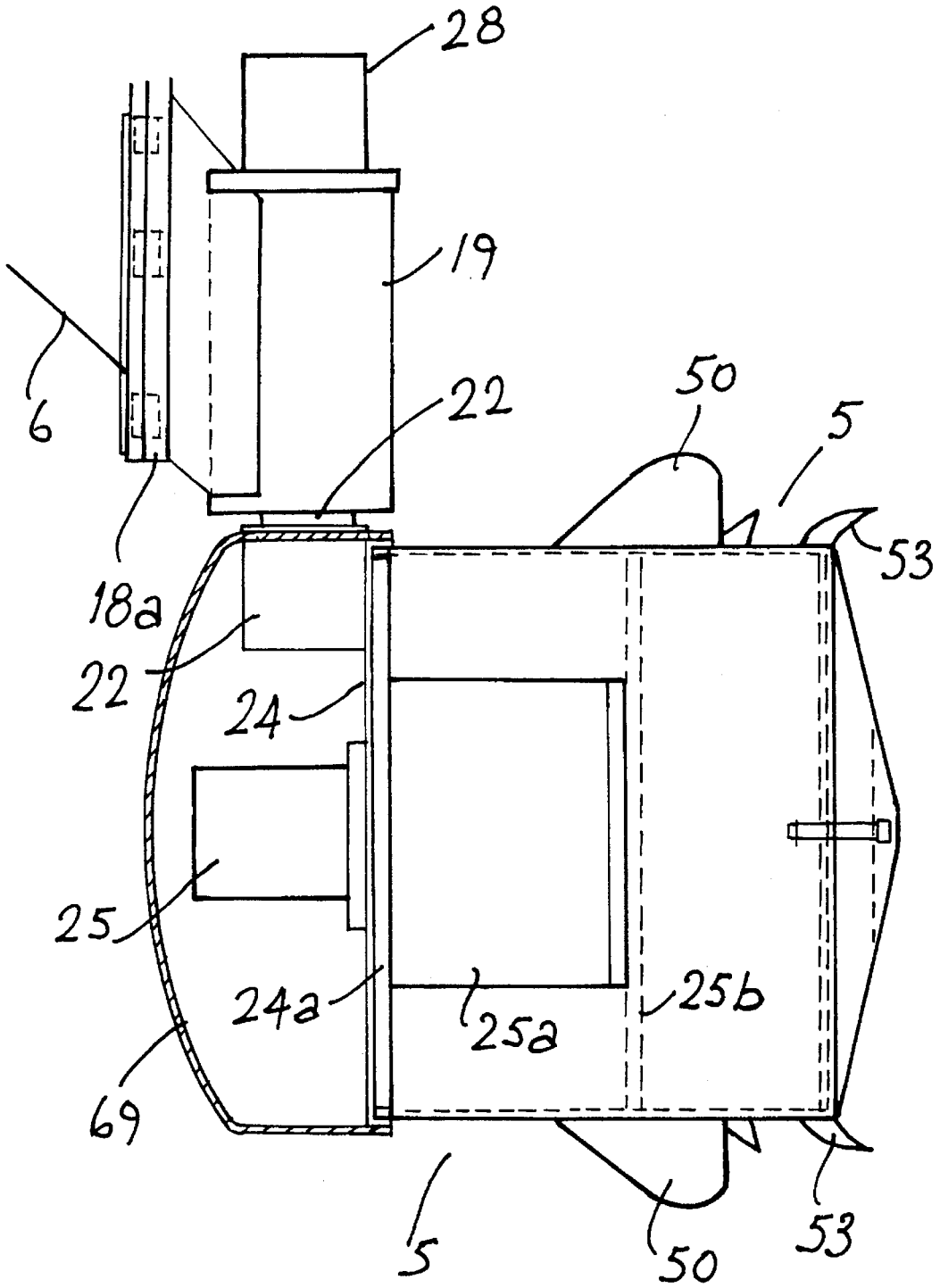
FIG. 5 is a partially sectioned detail view of the compacting roller.
Figure 6:
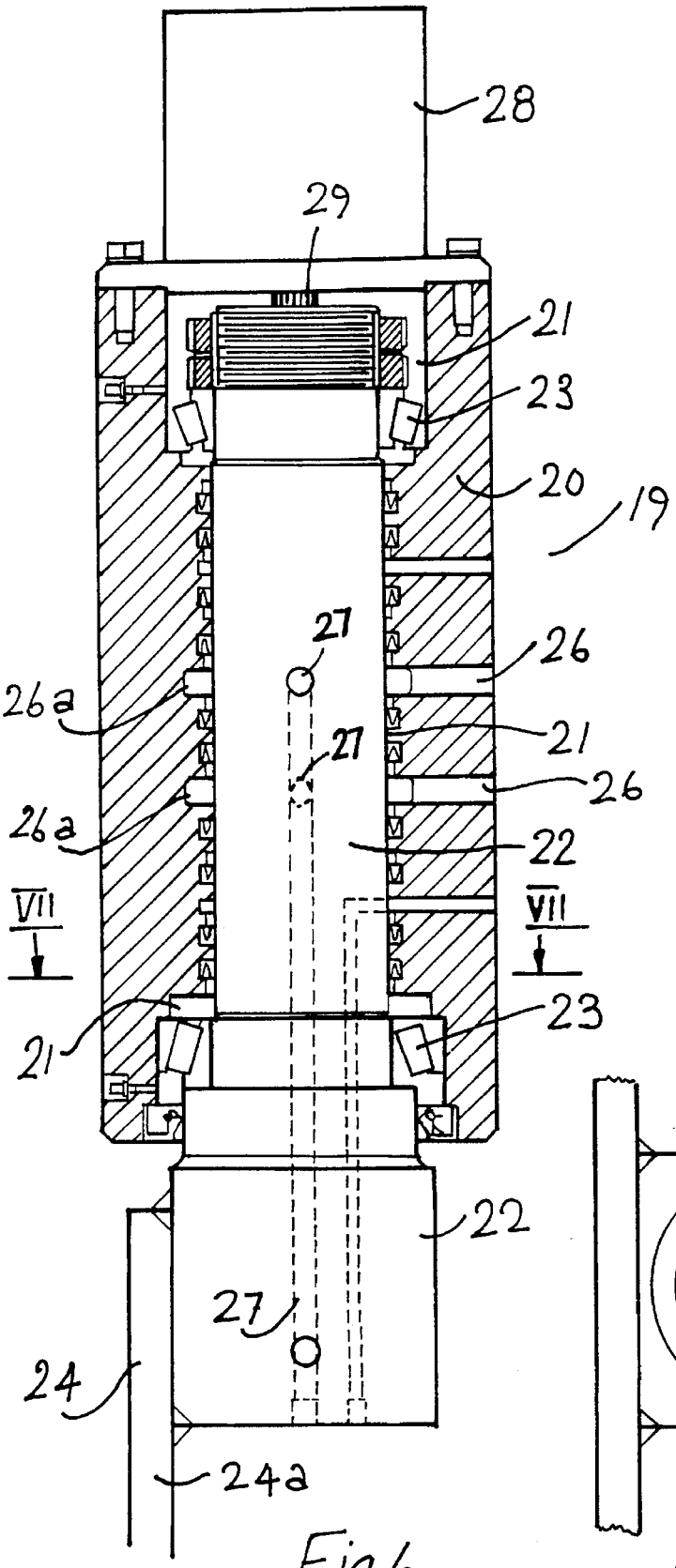
FIG. 6 is a partially sectioned detail view of hydraulic distributor forming portion of the compactor.
Figure 7:
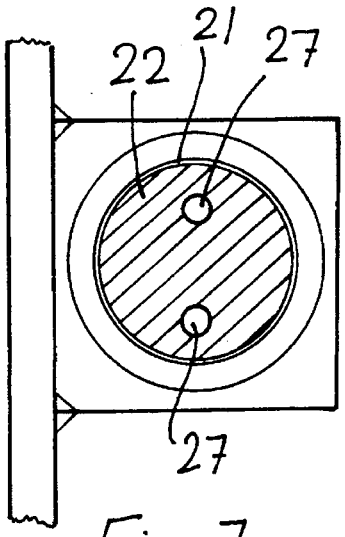
FIG. 7 is a sectional view taken along the line VII—VII of FIG. 6.

In use, waste materials such as cardboard boxes, plastics containers, wood, oil drums and the like can be fed into the waste compactor 1 through the inlet opening 67. Advantageously with the inclined arm 6 waste is guided downwardly into the roller path, the arm 6 causing less obstruction and fouling than the roller supports in other known types of waste compactor allowing in-feed of bulkier waste for a given size of waste container. By rotating the roller 5 the waste material is compacted beneath the roller 5 and compacted waste material 7 is built up from the bottom of the bag 60. As the roller 5 is rotated by its internal motor 25 the paddles 50 engage the waste 7 and pull the waste under the roller 5. To compact the waste material 7 the roller 5 is pushed downwardly against the waste 7 by means of the ram 12. It will be noted that the ram pressure setting is adjustable by means of the pressure relief valve 40 and when a pre-set desirable compacting pressure is achieved the roller 5 overcomes the ram bias and rises over the compacted waste 7 continually pushing down on the waste 7 for compaction. By adjustment of the pressure relief valve 40, the bias on the roller 5 can be adjusted to suit particular types of waste/ recycling material for optimum roller operation. It will be noted that the teeth 52 on the roller 5 fragment the waste as the roller 5 rotates. Further, the paddles 50 when rotating with the roller 5 seize and draw waste material from above the roller 5 to an underside of the roller 5 where it is fragmented and compacted. The direction in which the roller 5 is rotated by the drive motor 25 and the direction in which the roller 5 is circled on waste 7 by the sweep motor 28 is reversed at preset time intervals as previously described. Should the roller 5 meet a particularly resistant piece of waste, the hydraulic fluid supply pressure will rise tripping the pressure switch 42 for immediate reversal of the motors 25, 28. Thus the roller is backed around to tackle the waste from the opposite side. To raise the arm 6 for insertion and removal of the bag 60 the valve 35 is de-energised to supply fluid to the ram 12 to lift the arm 6 to a raised position as shown in FIG. 3. It will be appreciated that having a positive drive means such as the sweep motor 28 to circle the roller 5 is particularly advantageous. It ensures that the roller 5 is swept around the bag 60 even if there is no garbage in the bag 60 such as when starting to fill the bag 60. Waste can just be thrown in and the roller 5, as it sweeps around the bag 60, will meet and seize the waste pulling it underneath the roller 5 for compaction.

Figure 11:
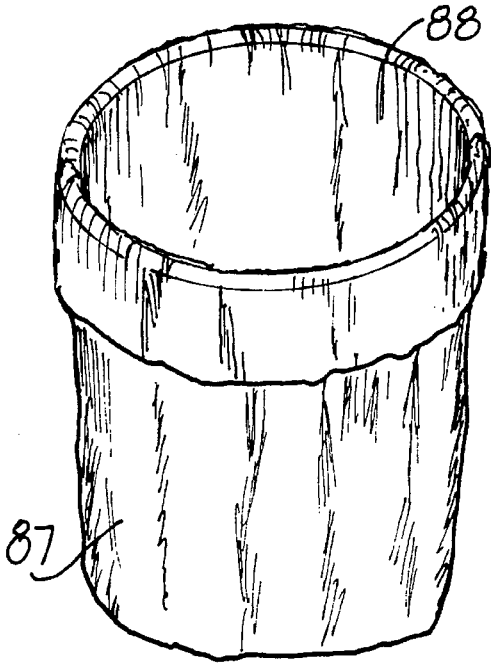
FIG. 11 is a detail perspective view of a removable round waste bag used in the compactor of FIG. 10.
Figure 10:
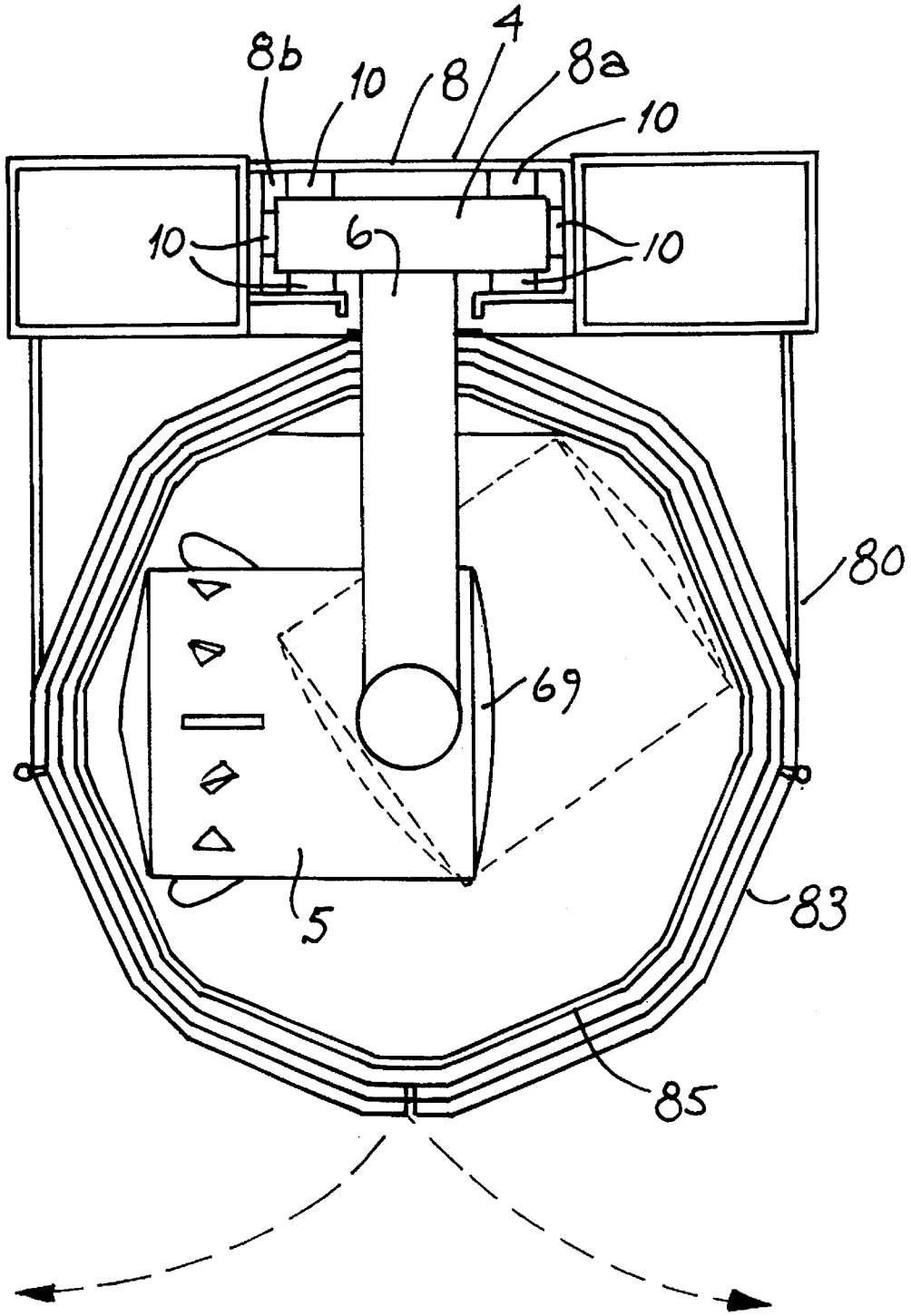
FIG. 10 is a plan view similar to FIG. 4 of another waste compactor.

Referring now to FIGS. 10 and 11, there is illustrated portion of another waste compactor 80 which is largely similar to the waste compactor previously described and like parts are assigned the same reference numerals. In this case, the compactor 80 has a container 83 of hexagonal shape. A complementary hexagonal collar 85 is suspended from the arm 6. A round section bag 87 is supported by a circular ring 88 within the container 83. Operation of the compactor 80 is similar to that previously described for the compactor of FIGS. 1 to 9.

Figure 12:
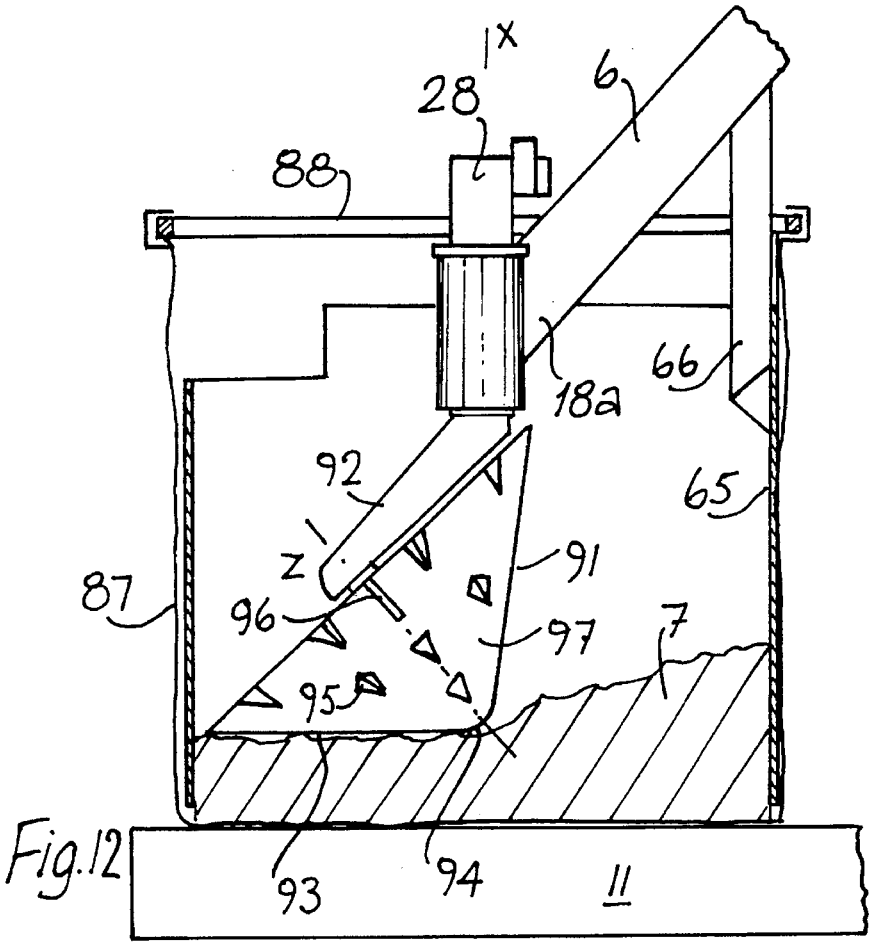
FIG. 12 is a detail sectional elevational view of portion of another waste compactor, showing an alternative roller construction.
Figure 9:
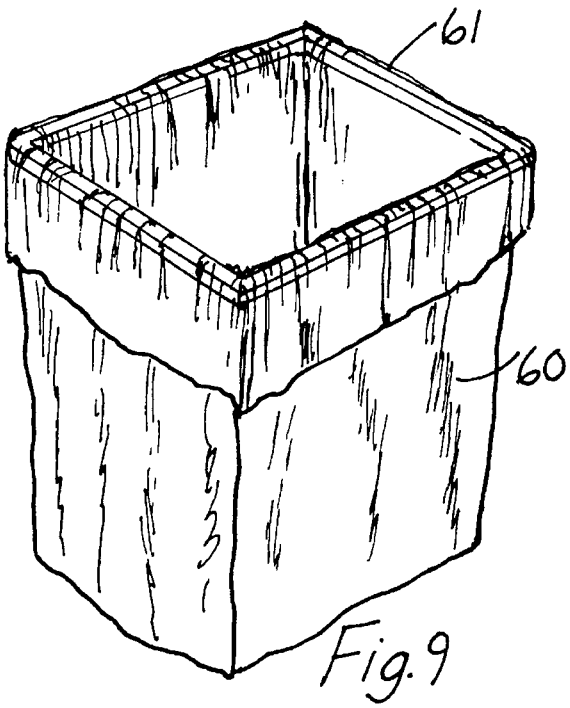
FIG. 9 is a detail perspective view showing a removable waste bag used with the waste compactor.

Referring now to FIG. 12 there is illustrated portion of another waste compactor which is largely similar to the waste compactor of FIGS. 1 to 9 and like parts are assigned the same reference numerals. In this case, a conical roller 91 is provided. The roller 91 is rotatably supported on an inclined carrier arm 92 rotatably mounted at the lower end 18*a* of the arm 6 and rotatably driven by the auxiliary sweep motor 28. It will be noted that the roller 91 has a relatively large cone angle, which in this case is approximately 90°. The roller 61 is supported such that a lowermost edge 93 of the roller travels along a plane substantially parallel to a base of the container 3. An apex 94 of the roller 91 lies substantially on the central axis X of the container and the roller axis Z is inclined at an angle of approximately half the cone angle to the base of the container. It will be noted also that the roller 91 tapers outwardly from a centre of the container 3 the length of the lowermost edge 93 being just shorter than the radius of the collar 65.

Waste shredding teeth 95 and paddles 96 are mounted on an outer waste compacting surface 97 of the roller 91 as previously described. In this case only the sweep roller 29 is provided to drive the roller 91. Rotation of the carrier arm 92 causes the roller 91 to engage and roll over waste within the bag 87. However, in some cases a drive motor may be provided for rotation of the roller 91 on the carrier arm 92 or indeed the roller 91 may be mounted on the arm 92 through a suitable gear drive which rotates the roller 91 upon rotation of the arm 92.

In use, the waste compactor is operated in similar fashion to the waste compactor shown in FIGS. 1 to 9. Due to the shallower approach angle of a waste contacting surface 94 of the conical roller 91 to the waste 7 it is better able to seize and draw waste beneath the roller 91 for fragmentation and compaction. Further it overcomes the slippage problems which can arise with cylindrical rollers.

Figure 14:
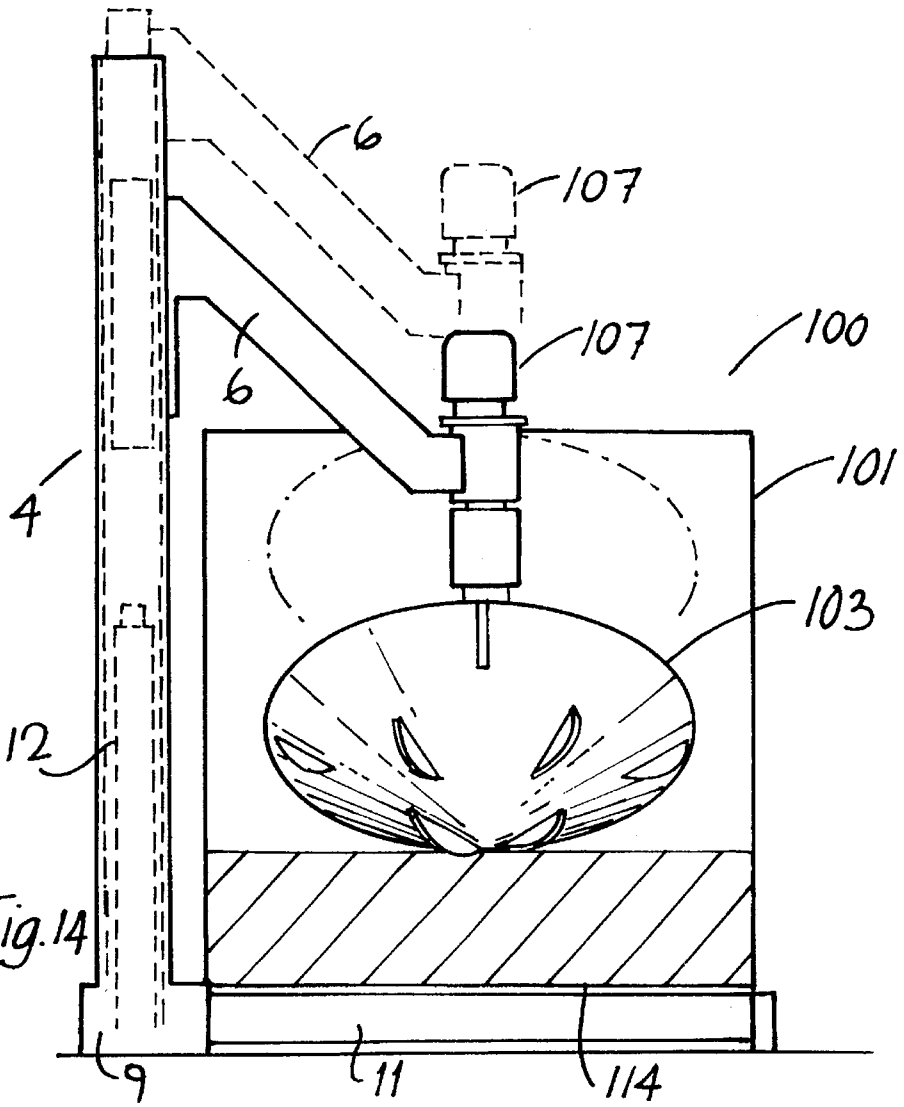
FIG. 14 is a diagrammatic side sectional elevational view of the compactor of FIG. 13.
Figure 13:
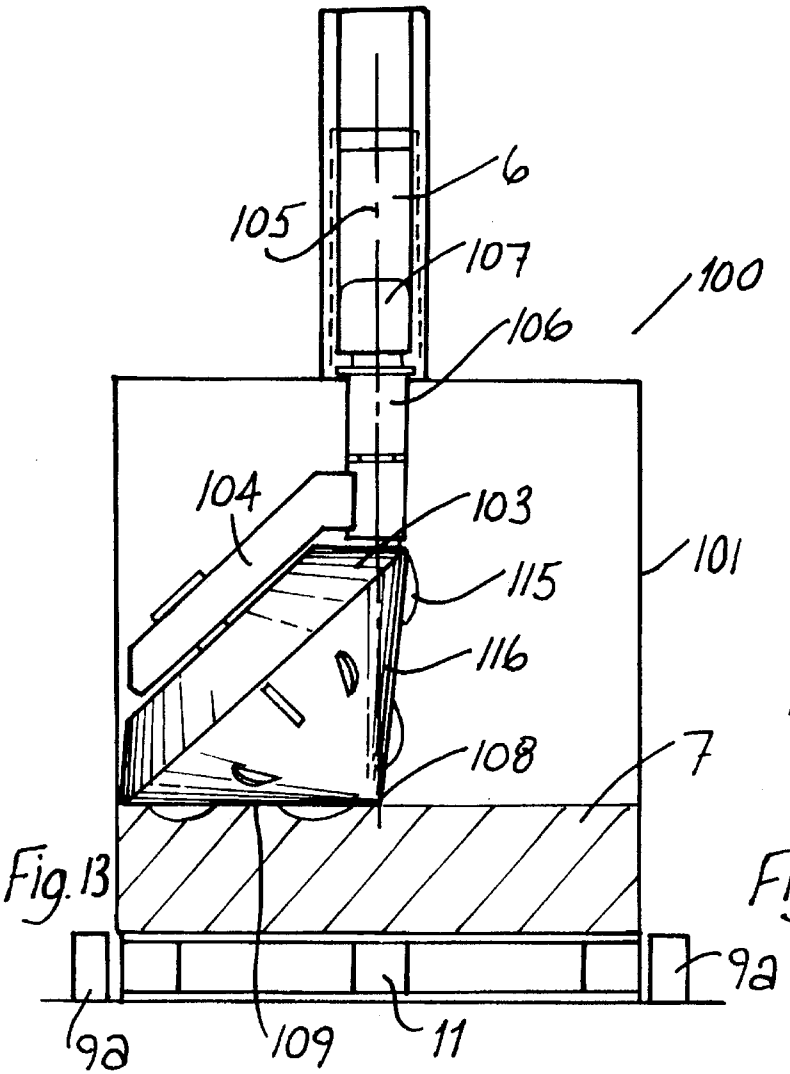
FIG. 13 is a diagrammatic front sectional elevational view of another waste compactor.
Figure 15:
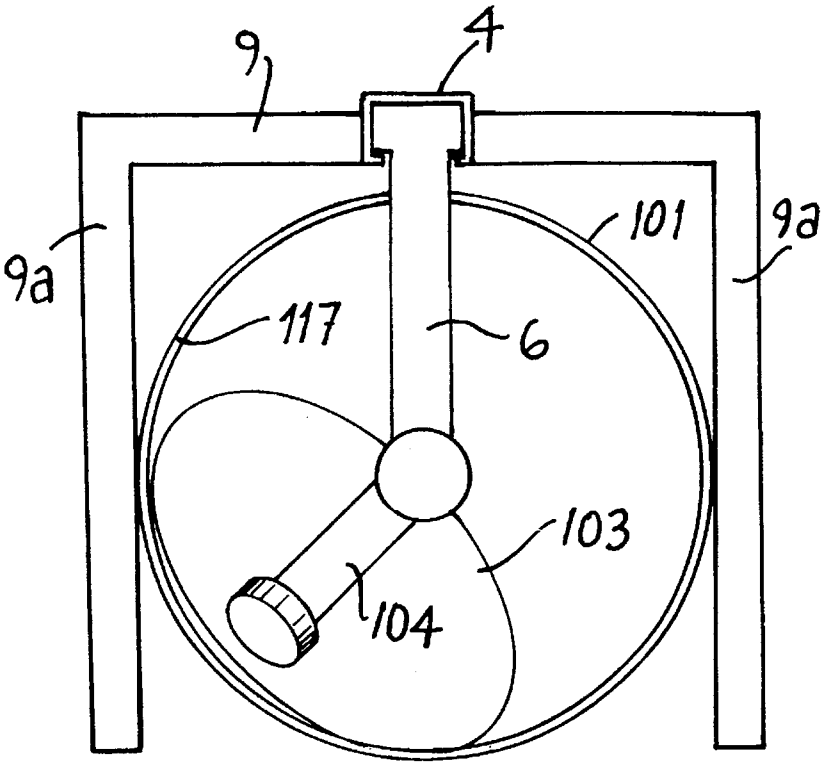
FIG. 15 is a diagrammatic plan view of the compactor shown in FIG. 13.

Referring now to FIGS. 13 to 15 there is illustrated another waste compactor 100 which again is largely similar to the waste compactor of FIGS. 1 to 9 and the like parts are assigned the same reference numerals. In this case, the waste compactor 100 incorporates a conical roller generally similar to that shown in FIG. 12. The waste compactor 100 has a container formed by a cylindrical compacting chamber 101 extending upwardly from a standard pallet 11. A conical compacting roller 103 is supported and guided by a carrier arm 104 which is constrained to rotate radially about a central vertical axis 105 of the chamber 101 by a shaft in bearings (not shown) inside a housing 106. The roller 103 may thus be positively caused to nutate about the axis 105 by means of a slow-speed high-torque motor 107. It will be noted that the position of an apex 108 of the roller 103 coincides with the vertical axis 105 of the chamber 101. Also the length of a side 109 of the roller 103 is slightly less than the radius of the chamber 101; and the axis of the roller 103 lies radially at an angle of half the included cone angle to the horizontal.

The housing 106 is securely fixed to a rigid inclined arm 6 which is mounted on the upstanding support frame 4 in similar fashion to the waste compactor shown in FIGS. 1 to 9.

In operation, the carrier arm 104 is rotated about the axis 105 by the motor 107. This in turn causes the roller 103 to roll around on waste 7 inside the chamber 101 with a nutating motion. Waste material dropped into the chamber 101 will be met by the roller 103 which will seize and pull the waste underneath the roller 103 shredding and compacting the waste material. As more and more waste material 7 is added to the chamber 101 the roller 103 rises with the arm 6 as previously described crushing and rolling waste 7 level inside the chamber 101. The rotor 103 is provided with a number of spaced-apart teeth or grousers 115 on a waste contacting surface 116 of the roller 103 which help to tear and shred the waste material 7 so breaking it into smaller pieces and helping it to pack uniformly and level inside the chamber. 101, and meanwhile the roller 103 climbs higher and higher inside the chamber 101 as the compacted waste material 7 builds up.

Referring now in particular to FIG. 14 the dotted profile shows the roller 103 and arm 6 having risen almost to the top of the chamber 101, and eventually the chamber 101 will be completely filled with compacted and shredded waste material. At this stage, the motor 107 is stopped and the ram 12 is extended to lift the roller 103 clear of the top of the chamber 101 in order that a stillage lifter or forklift truck may engage the pallet 11 and remove the filled chamber 101 and replace it with an empty chamber 101.

FIG. 15 is a plan view of the compactor showing how the roller 103 closely follows an inner sidewall 117 of the chamber 101.

Figure 16:
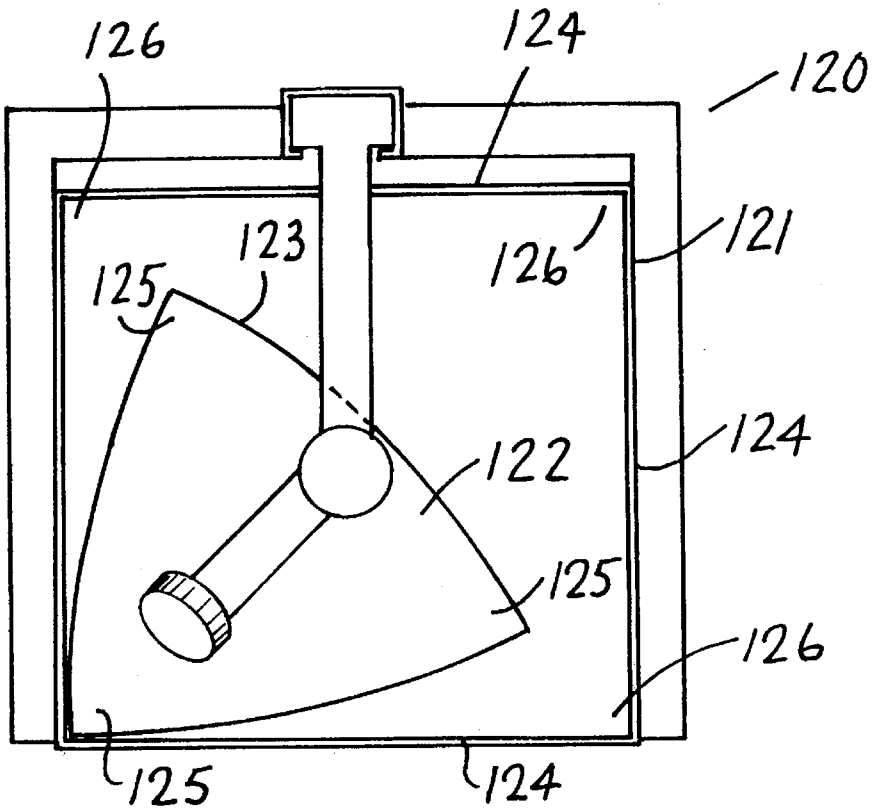
FIG. 16 is a diagrammatic plan view similar to FIG. 15 of another compactor having a different waste compacting roller.

Referring now to FIG. 16 there is shown another waste compactor 120 which is largely similar to the waste compactor of FIGS. 13 to 15 and like parts are assigned the same reference numerals. In this case, the waste compactor 120 has a waste container formed by a square-section compacting chamber 121. Matching the chamber 121 is a complementary three-cornered conical roller 122. A perimeter of each edge 123 of the roller 122 is slightly less than the internal length of each sidewall 124 of the square chamber 121. Thus, as the roller 122 nutates inside the chamber 121 projecting corners 125 of the roller 122 will engage and mesh with the inside corners 126 of the chamber 121 in turn to closely follow the contour of the sidewall oft he chamber 121.

Figure 17:
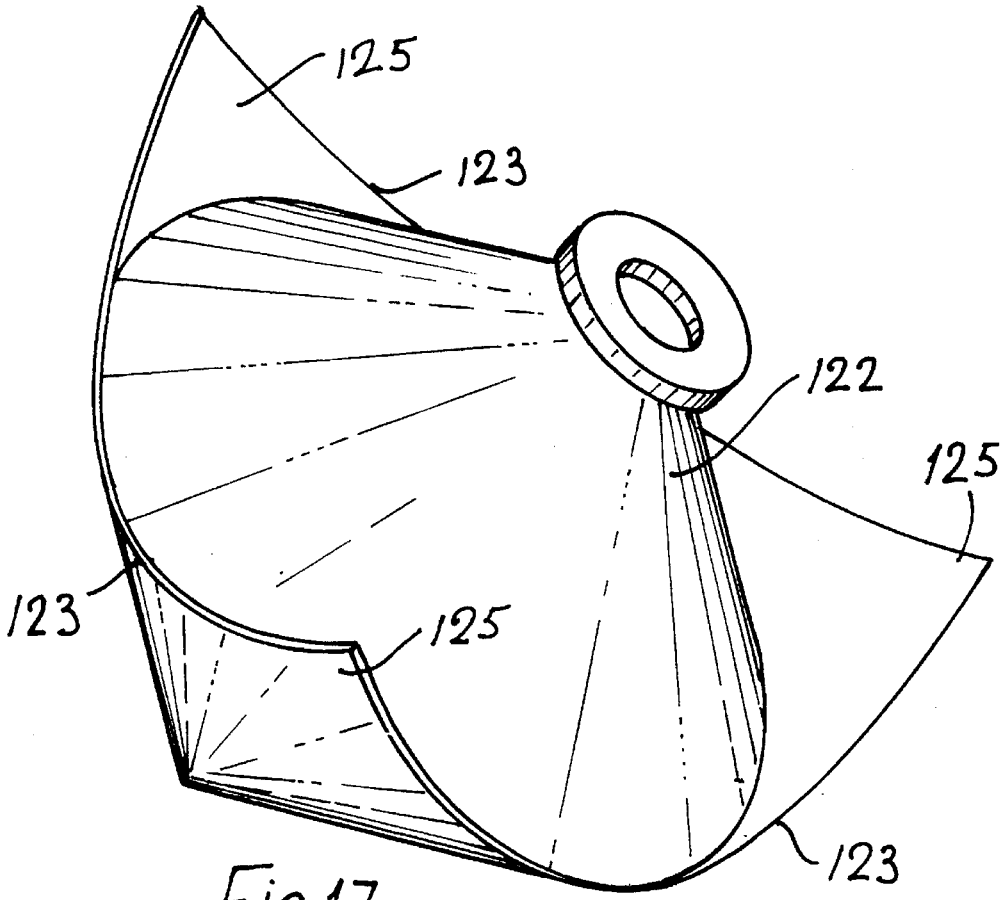
FIG. 17 is a perspective view of the roller of the compactor of FIG. 16.

FIG. 17 shows in perspective view the three-cornered conical roller 122 in order that its shape may be more easily envisaged. The included angle of the cone is approximately 97°, so its axis should be set at around 46.5° to the horizontal inside the compacting chamber 121. Note that a section through the roller 122 at right angles to its axis will be circular, and that the corners 125 are merely extensions of the conical surface which are specially shaped so as to produce the correct peripheral profile.

Figure 18A:
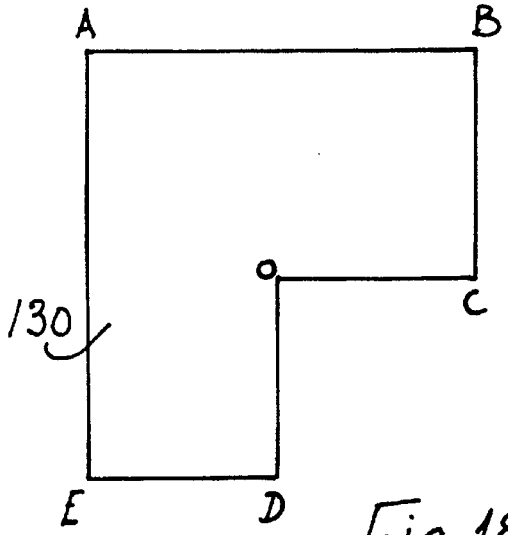
FIG. 18(*a*) and FIG. 18(*b*) show a development of the roller shown in FIG. 17.
Figure 18B:
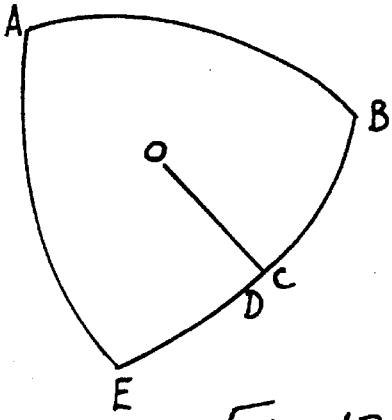

FIG. 18(*a*) and FIG. 18(*b*) show how the correct profile may be generated by cutting a corner D-O-C out of a flat square plate 130, the size of the plate 130 being a clearance fit inside the square compacting cheer 121. It will be readily apparent that if the corners D and C are drawn together the plate must deflect into a third dimension to form a conical shape having an apex at O and whose base profile is exactly that desired, the curved lengths of the sides AB, BE and EA being a good rolling clearance fit inside the square compacting chamber 121.

It will be appreciated that the invention provides a rotary compacting apparatus whose compacting roller can reach out to the perimeter of the compacting chamber, the rotor travelling over the surface of the compacted waste without any substantial relative slippage, and whose compacting chamber may also be optionally cylindrical, polygonal or square in cross-section.

It is envisaged that a positive driving means may be provided to drive the roller about its longitudinal axis in synchronism with the nutating motion. This may be by means of a motor mounted on the carrier arm 104 or preferably within the roller 122 or by having a geared connection between the carrier arm 104 and the roller 122 such that as the carrier arm 104 rotates on the support arm 6 the roller 122 is caused to rotate on the carrier 104 by the gearing.

It is further envisaged that the motor which drives the guide arm may be omitted altogether and the apparatus may be driven only by motorising the roller.

It will be appreciated that the compacting chamber may consist of a plastics bag which stands upon the pallet, the bag being protected by a sleeve which slides inside the bag embracing the operating space of the roller, and rising with the roller as the bag fills with waste material, and rising clear of the bag with the roller to facilitate bag removal and renewal as previously described.

It will be appreciated that the use of the shock absorbing spring in conjunction with the ram is advantageous in that it allows the roller on meeting waste to initially deflect upwards quickly to ride over and crush waste underneath the roller without having to move the ram upwardly, the spring reacting quicker than the ram.

The invention is not limited to the embodiments hereinbefore described which may be varied in both construction and detail.

We claim:

1. A waste compactor comprising:

an upwardly open waste container;

a roller for movement within the container to travel over waste in the container for compacting waste;

a support for the roller, the support comprising a support frame, a support arm mounted to the support frame and extending into the container, a carrier arm mounting the roller to the support arm, the carrier arm being rotatable about a central axis of the container, the support arm being inclined downwardly from the support frame towards the roller, the support arm being vertically slidable on the support frame for moving the roller up and down in the container as waste builds up in the container; and drive means for rotating the roller, comprising an hydraulic roller motor mounted on the carrier arm, a rotary hydraulic distributor mounted between the carrier arm and the support arm for oil passage between an hydraulic power supply and the roller motor to drive the motor.

2. A waste compactor as claimed in claim 1 wherein a ram is provided for moving the roller through the container, the ram being operable to move the roller and to apply a bias to the roller to control the compaction pressure applied to the waste by the roller.

3. A waste compactor as claimed in claim 2 wherein the roller is movable against a preset ram bias to maintain a substantially constant pre-set desirable roller compaction pressure on the waste during operation.

4. A waste compactor as claimed in claim 2 wherein the ram applies a ram force which is adjustable.

5. A waste compactor as claimed in claim 2 wherein the support arm is slidably mounted on the support frame and the ram is mounted between the support arm and the support frame for sliding the arm on the support frame.

6. A waste compactor as claimed in claim 2 wherein a shock absorber is provided between the ram and the roller to absorb shock loading on the roller.

7. A waste compactor as claimed in claim 6 wherein the shock absorber is of resilient material.

8. A waste compactor as claimed in claim 6 wherein the shock absorber comprises a shock absorbing spring.

9. A waste compactor as claimed in claim 6 wherein the shock absorber is provided between the ram and the support arm to absorb shock loading on the roller.

10. A waste compactor as claimed in claim 1 wherein carrier arm drive means is provided for rotation of the carrier arm about the central axis of the container.

11. A waste compactor as claimed in claim 10 wherein each of the roller drive means and carrier arm drive means is reversible.

12. A waste compactor as claimed in claim 10 wherein each of the roller drive means and carrier arm drive means is reversible and each reverses at preset time intervals.

13. A waste compactor as claimed in claim 10 wherein each of the roller drive means and carrier arm drive means is reversible in response to the force exerted on the roller by waste within the container resisting roller movement.

14. A waste compactor as claimed in claim 10 wherein the carrier arm drive means is an hydraulic carrier arm motor connected to an hydraulic power supply.

15. A waste compactor as claimed in claim 1 wherein the distributor comprises a cylindrical body having a bore, a shaft rotatably mounted within the bore, a free end of the shaft projecting outwardly of the bore, the carrier arm being mounted at the free end, a oil supply port and an oil return port in an sidewall of the body, each port communicating with an associated annular oil channel extending around the bore, an oil passage extending through the shaft between each channel and free outer end of the shaft for oil delivery to and from the motor.

16. A waste compactor as claimed in claim 15 wherein the carrier arm motor is mounted on the distributor body drivably engaging the shaft.

17. A waste compactor as claimed in claim 1 wherein the waste container is of polygonal cross-section having a number of internal corners.

* * * * *